US011745989B2

(12) United States Patent
Moufawad

(10) Patent No.: US 11,745,989 B2
(45) Date of Patent: Sep. 5, 2023

(54) JAR LID OPENER

(71) Applicant: Samir Moufawad Moufawad, Mazraat Yashouh (LB)

(72) Inventor: Samir Moufawad Moufawad, Mazraat Yashouh (LB)

( * ) Notice: Subject to any disclaimer, the term of this patent is extended or adjusted under 35 U.S.C. 154(b) by 283 days.

(21) Appl. No.: 17/026,174

(22) Filed: Sep. 19, 2020

(65) Prior Publication Data

US 2022/0089423 A1 Mar. 24, 2022

(51) Int. Cl.
*B67B 7/14* (2006.01)

(52) U.S. Cl.
CPC ..... *B67B 7/14* (2013.01)

(58) Field of Classification Search
CPC ..... B67B 7/18; B67B 7/14
USPC ..... 81/3.37
See application file for complete search history.

(56) References Cited

FOREIGN PATENT DOCUMENTS

DE 102007006738 A1 * 1/2009 ..... B67B 7/18
GB 648030 A * 9/1949

OTHER PUBLICATIONS

Translation of DE102007006738A1, retrieved from Espacenet on Sep. 15, 2022 (Year: 2009).*

* cited by examiner

*Primary Examiner* — Thomas Raymond Rodgers

(57) ABSTRACT

Rotating or pressing one or more handles will rotate one or more cams which push on the lid side. This causes a lever to rotate and forces two opposing jaws to press on the jar. With further rotating or pressing, the cam(s) rotates more and its rough surface or teeth forces the lid to rotate with high torque. Since the cam size is smaller than the lid diameter, much less force is needed to open the lid. And since the jar lid opener grips both the lid and the jar at the same time, there is no need to hold the jar tight while rotating or press the handles.

4 Claims, 5 Drawing Sheets

JAR LID OPENER

BACKGROUND OF THE INVENTION

Field of the Invention

Embodiments of the invention described herein pertain to the field of kitchenware. More particularly, but not by way of limitation, one or more embodiments of the invention enables a jar lid opener with lid and jar gripping and high torque rotating or pressing.

Description of the Related Art

Jar lid openers are available and do well in gripping the lid of the jar. However, the ones which provide high torque to be able to open the lid easily are not easy to use such as U.S. Pat. No. 6,862,960. Most seem to have to rotate hard on the tool while the user has to hold the jar at the same time such U.S. Pat. Nos. 1,498,009 and 6,854,361. Some provide means to also hold the jar; however they are bulky such as U.S. Pat. Nos. 5,370,019 and 5,345,844. The present invention is a manual jar lid opener which provides griping both the lid and the jar with high torque in order to open the lid easily.

BRIEF SUMMARY OF THE INVENTION

12 - Arm, 12.1 -Teeth, 13 - Link, 14 - Jaw, 14.1 - rubber or plastic polymers, 10 Jar, 16 - Lever, 16.1 - Hole, 16.2 -Tooth, 18 - Lever, 18.1 - Pin, 19 - Jaw, 19.1 - Protective or gripping material, 15 - Handle, 15.1 - Link, 17 - Cam, 17.1 - Teeth, 11.1 +Lid side, 18.2 - Pin, 11 - Lid, 45 - Handle, 42 - Arm, 42.4 - Portion ofarm 42, 41 - Lid, 46.3 - Manual locking mechanism, 46.7 - Force, 46.4 - Tooth, 42.1 - Teeth, 46 - Lever, 40 - Jar, 46.5 - Spring, 48.4 - Spring, 48.3 - Stopper, 42.3 - Partial teeth of42.1, 47 - Cam, 41.1 - Lid side, 44.1 - Protective or gripping material, 49.1 - Protective or gripping material, 40 - Jar, 47.1 - Rough surface or teeth, 41 - Lid, 53.1 - Cam, 55.1 - Cam, 53 - Handle, 54 - Handle, 51.1 - Lid side, 54.1 - Gear, 55 - Gear, 55.3 - Pins, 55.4 - Rough surface, 51 - Lid, 52 - Arm, 59.1 - Plate, 59.6 - Plate, 59 - Jaw, 59.5 - Jaw, 59.2 - Protective or gripping material, 59.7 - Protective or gripping material, 50 - Jar, 80 - Jar, 84 - Arm, 85 - Arm, 84.1 - Teeth, 85.1 - Tooth, 83 - Link, 86 - Link, 88.2 - Cam, 88.3 - Gripping material, 87.1 - Cam, 87.2 - Teeth, 82 - Jaw, 89 - Jaw, 80 - Jar, 87 - Handle, 88 - Handle, 88.1 - Gear, 80 - Jar, 81.1 - Lid side, 102 - Manual lock, 101 - Arm, 103 - Arm, 102.1 - Force, 102.2 - Tooth, 101.1 - Teeth, 103 - Hollow arm, 100 - Jar, 104 - Spring, 107 - Handle, 105 - Part of arm 103, 104.1 - Cam, 106 - Lid.

In one configuration, the present invention has an arm, two jaws with a protective or gripping material such as rubber of plastic, one rotating handle, at least one lever, at least one link, and at least one cam with rough surface or teeth. In a second configuration, the present invention has a handle and an arm which are pressed. In a third configuration, two handles are pressed.

When the handle is rotated, or arm and handle or two handles are pressed, at least one cam rotates and pushes on the lid side. This causes the levers to rotate outward, thus causing one lever to lock to the arm and the other lever to press with its jaw on the jar. Protective or gripping material is coupled to the jaws for better gripping of the jar and to avoid damage of the jar. With further rotating, the teeth of the cam come in contact with the side of the lid and rotate and open the lid. With all configurations, the technique of a cam pushes on the lid side causing jaws to press on the jar, and with further rotating of pressing of handles causing the teeth of cam to rotate the lid. Besides the number of handles and the pressing and rotating, what differs between configurations is the number of cams and the way they are rotated, and the locking mechanism.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

The jar lid opener will now be described using exemplary embodiments of the invention. It will be apparent to an ordinary skilled in the art person that the present invention may be practiced without incorporating all its aspects herein. Readers should note that although examples of the invention are set forth herein, the claims, and the full scope of any equivalents, are what define the metes and bounds of the inventions.

Figure 1:
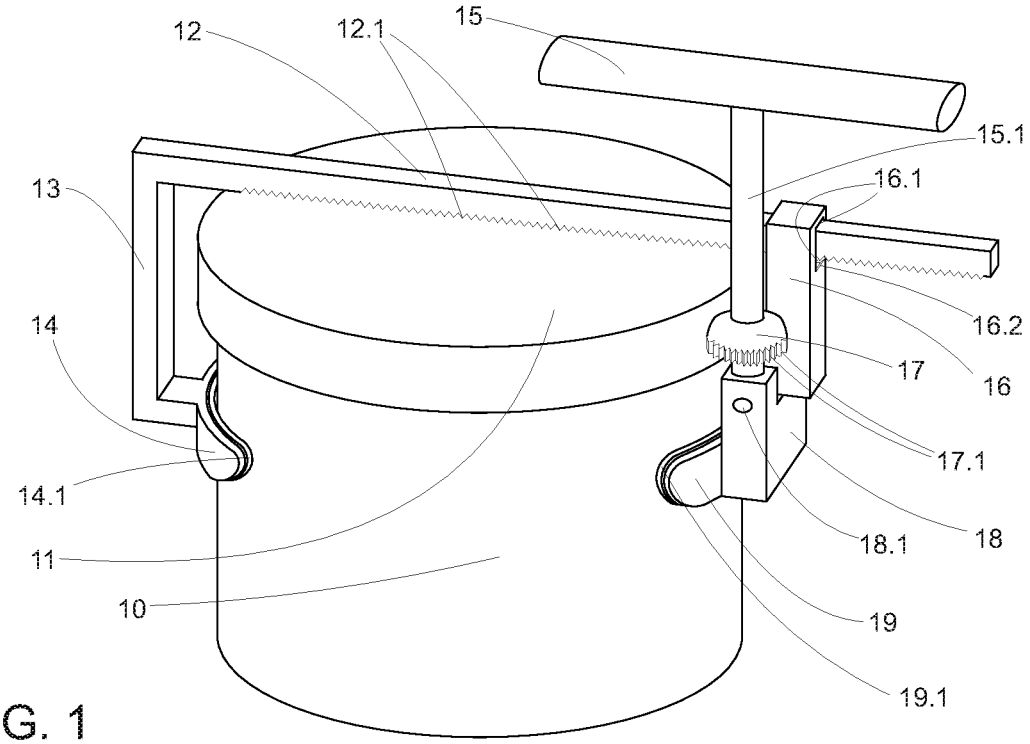
FIG. 1 is a diagram of an exemplary embodiment with a rotating handle in accordance with the jar lid opener describe herein.

FIG. 1 is a diagram of an exemplary embodiment with a rotating handle in accordance with the jar lid opener describe herein.

Arm 12 has at the bottom teeth 12.1 which will serve as a locking mechanism. Link 13 is coupled to one end of arm 12, and jaw 14 is coupled to the bottom of link 13. Protective or gripping material such as rubber or plastic polymers 14.1 is coupled to jaw 14 for better gripping and to prevent damaging jar 10.

Lever 16 can slide on arm 12 through its hole 16.1 which has at least one tooth 16.2 at the bottom edge. Tooth 16.2 will engage teeth 12.1 to enable lever 16 to lock onto arm 12. Lever 18 is rotationally coupled to lever 16 though pin 18.1. Jaw 19 is coupled at the bottom of lever 18, and protective or gripping material 19.1 is coupled to jaw 19.

A handle 15 is rotationally coupled to the upper part of lever 18 through link 15.1. And a cam 17 with teeth 17.1 is couple to link 15.1.

Figure 2:
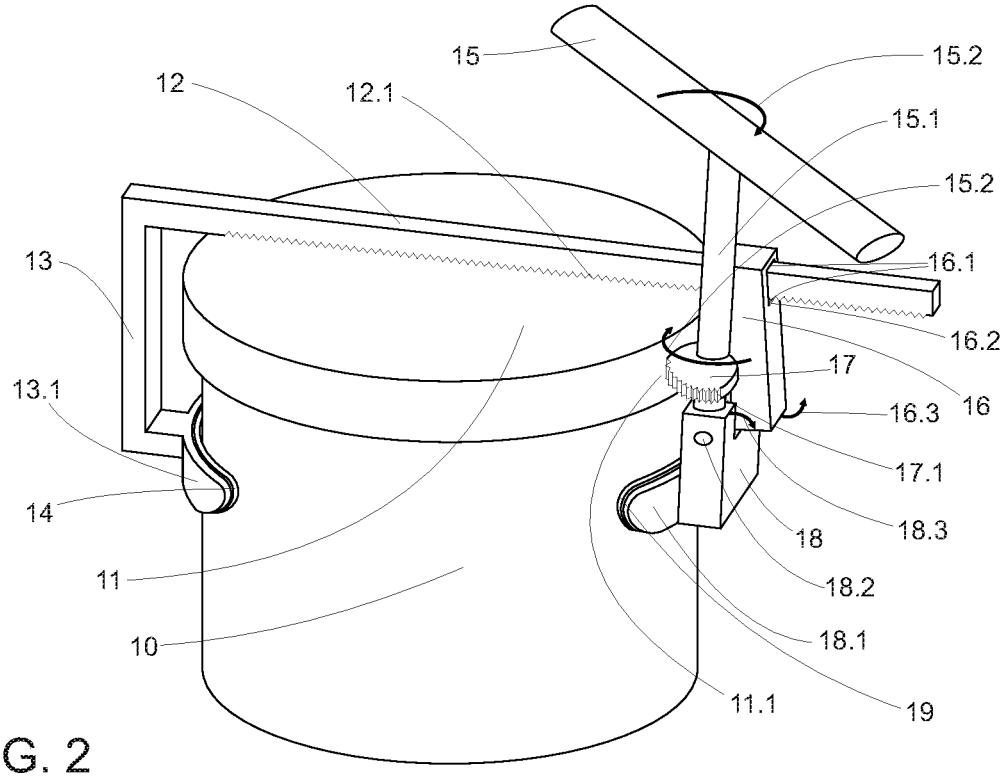
FIG. 2 illustrates an exemplary embodiment with a rotating handle rotated clockwise and locking a lever to an arm and pressing a jaw to the jar in accordance with the jar lid opener describe herein.

FIG. 2 illustrates an exemplary embodiment with a rotating handle rotated clockwise and locking a lever to an arm and pressing a jaw to the jar in accordance with the jar lid opener describe herein.

When handle 15 is rotated clockwise 15.2, link 15.1 rotates clockwise 15.2 cam 17 which pushes on lid side 11.1. This causes link 15.1 to move away from lid side 11.1, and causes lever 16 and 18 to rotate. Lever 16 rotates clockwise 16.3 around pin 18.2, and causes teeth 16.2 to engage teeth 12.1 and locks lever 16 to arm 12. Lever 18 rotates counterclockwise 18.3, and the bottom of lever 18 pushes on jaw 19 which pushes on protective or gripping material 19. which in turn pushes on jar 10. When protective or gripping material 19.1 pushes on jar 10, protective or gripping material 19.1 also presses on jar 10 thus preventing it from rotating.

Figure 3:
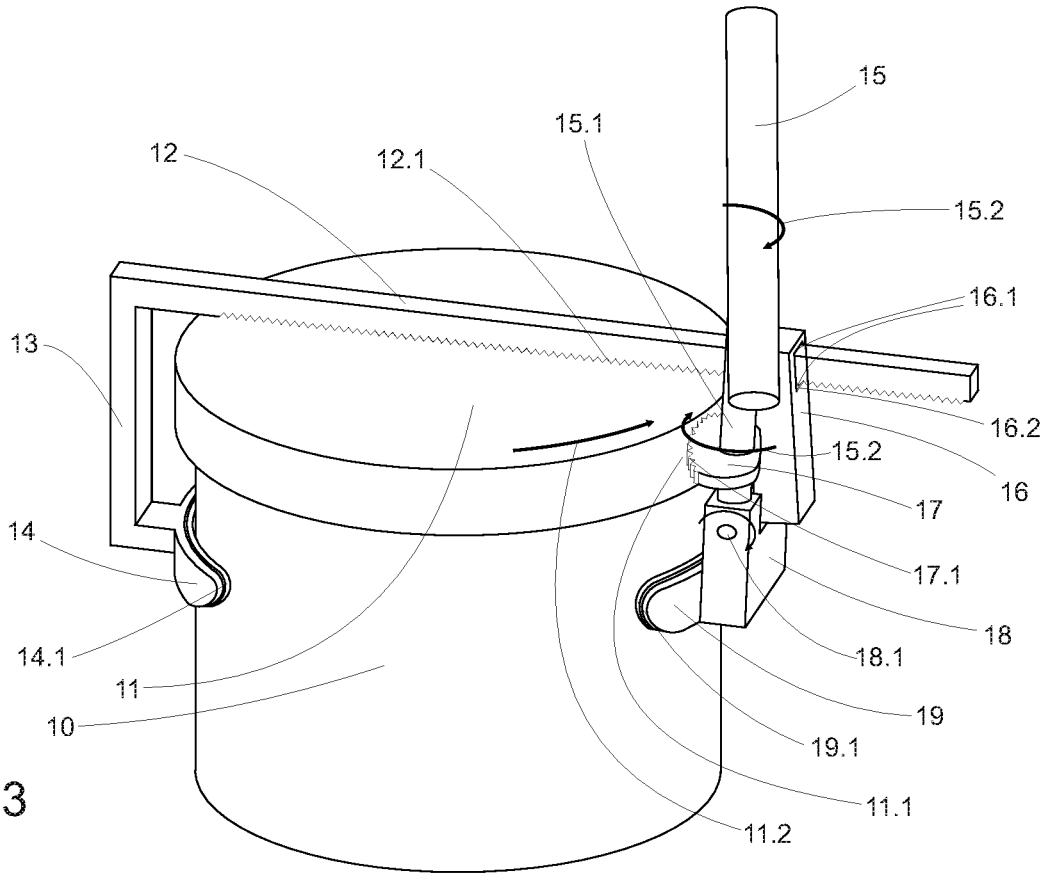
FIG. 3 illustrates an exemplary embodiment with a rotating handle further rotated clockwise and a cam opening the lid in accordance with the jar lid opener describe herein.

FIG. 3 illustrates an exemplary embodiment with a rotating handle further rotated clockwise and a cam opening the lid in accordance with the jar lid opener describe herein.

With further clockwise rotation 15.2 of handle 15, cam 17 rotates more clockwise 15.2 and teeth 17.1 come in contact with lid side 11.1. Since protective or gripping materials 19.1 and 14.1 are preventing jar 10 from rotating, teeth 17.1 rotate lid side 11.1 counterclockwise 11.2 thus opening lid 11.

Cam 17 diameter is smaller than the lid 11 diameter; therefore less force is needed to create the necessary torque to open lid 11.

This configuration offers the option of turning handle 15 also counterclockwise which causes lid 11 to be tightened.

With all configurations, the technique of opening the lid is the same: a cam pushing on the lid side causing jaws to press on the jar, and with further rotating or pressing of handles the rough surface or teeth or pins or gripping material of the cam rotates the lid. So what differs between configurations is the rotating or pressing one or two handles, the number of cams and the way they are rotated, and the locking mechanism.

Figure 4:
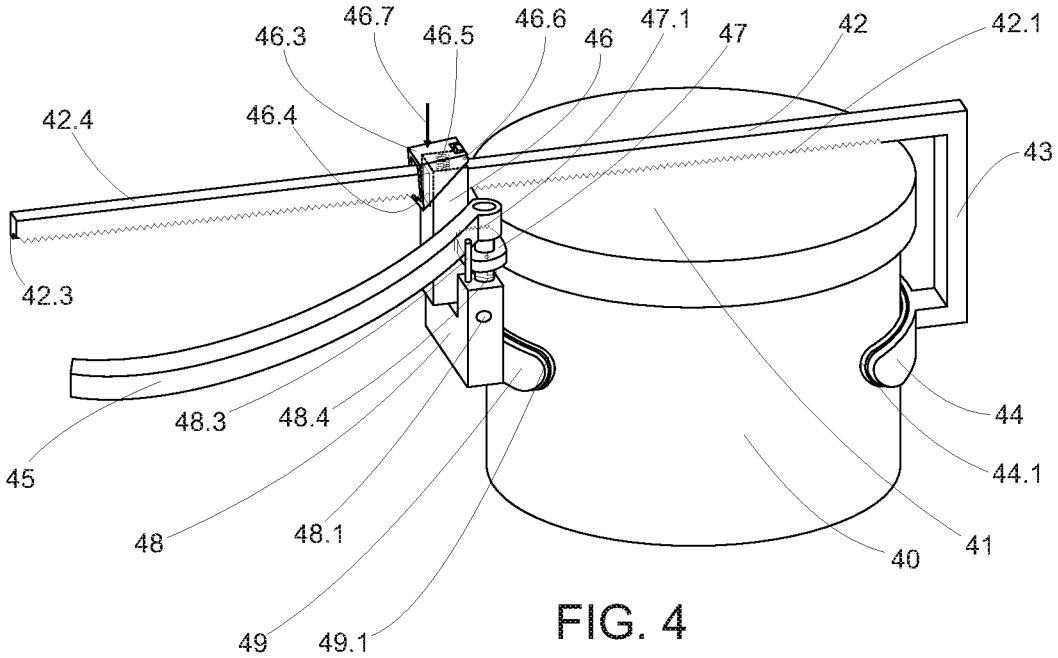
FIG. 4 illustrates an exemplary embodiment with a pressing arm and a handle and a manual locking mechanism in accordance with the jar lid opener describe herein.

FIG. 4 illustrates and exemplary embodiment with a pressing arm and a handle and a manual locking mechanism in accordance with the jar lid opener describe herein.

Handle 45 and arm 42.4 which is a portion of arm 42, are pressed together to open lid 41. A manual locking mechanism 46.3 is pushed down by force 46.7 to disengage tooth 46.4 from teeth 42.1 and to allow lever 46 to slide and adjust to the size of jar 40. After force 46.7 is removed, spring 46.5 raises locking mechanism 46.3 back to its original position, thus reengaging tooth 46.4 to teeth 42.1 and locking lever 46 to arm 42. Spring 48.4 will reopen handle 45 after it is released until reaching stopper 48.3. Teeth 42.1 are made partial 42.3 at the bottom of arm 42. This is to allow pressing of arm 42 without teeth 42.1 hindering the pressing hand.

Figure 5:
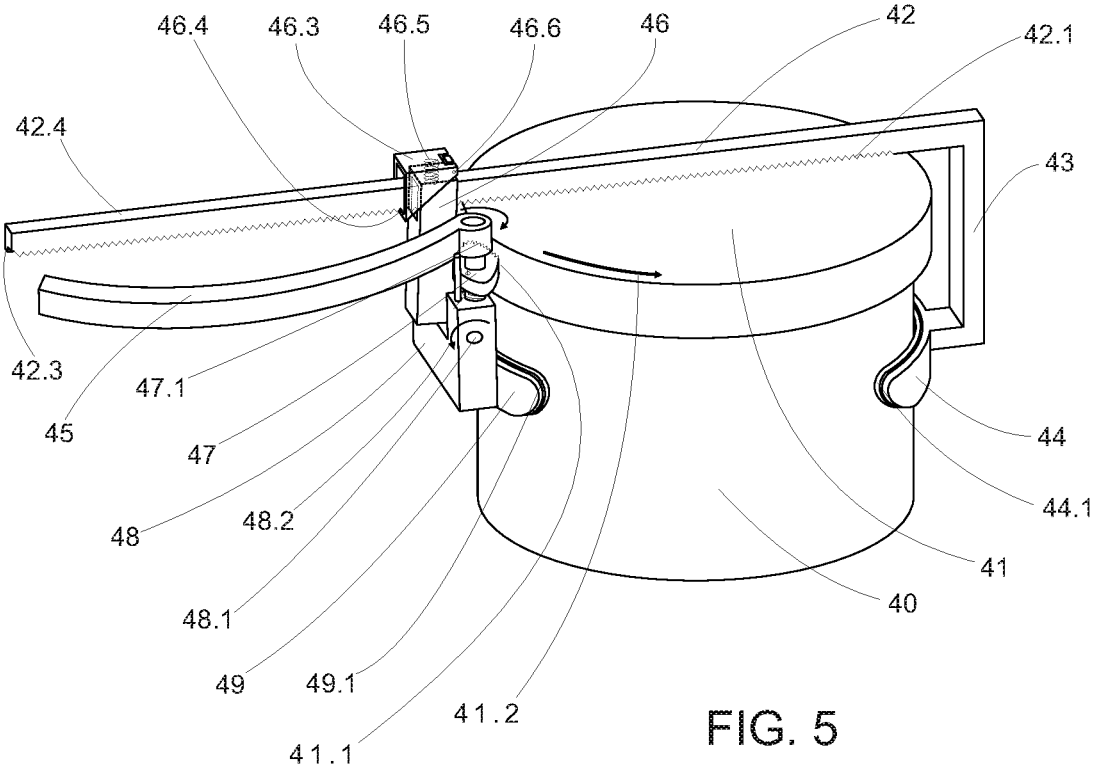
FIG. 5 illustrates an exemplary embodiment with a handle and arm pressed together and a cam opening the lid in accordance with the jar lid opener describe herein.

FIG. 5 illustrates an exemplary embodiment with a handle and arm pressed together and a cam opening the lid in accordance with the jar lid opener describe herein.

With locking mechanism 46.3 in original position and lever 46 is locked to arm 42, when handle 45 and arm portion 42.4 are pressed together, cam 47 rotates clockwise and pushes on lid side 41.1, and as described before, this causes protective or gripping material 44.1 and 49.1 to press on jar 40, and with further pressing of handle 45 and arm portion 42.4 the rough surface or teeth 47.1 rotates lid 41 counterclockwise 41.2 and opens it.

Figure 6:
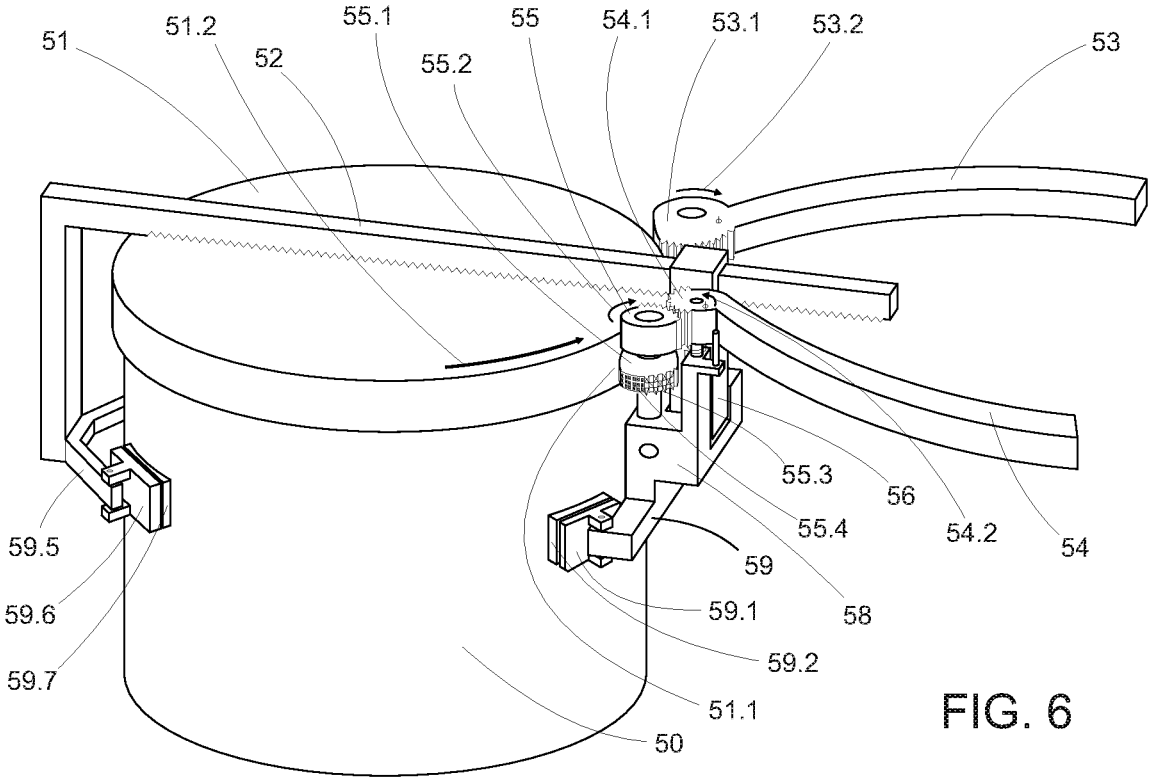
FIG. 6 is a diagram of exemplary embodiment with two pressing handles in accordance with the jar lid opener describe herein.

FIG. 6 is a diagram of exemplary embodiment with two pressing handles in accordance with the jar lid opener describe herein.

Figure 7:
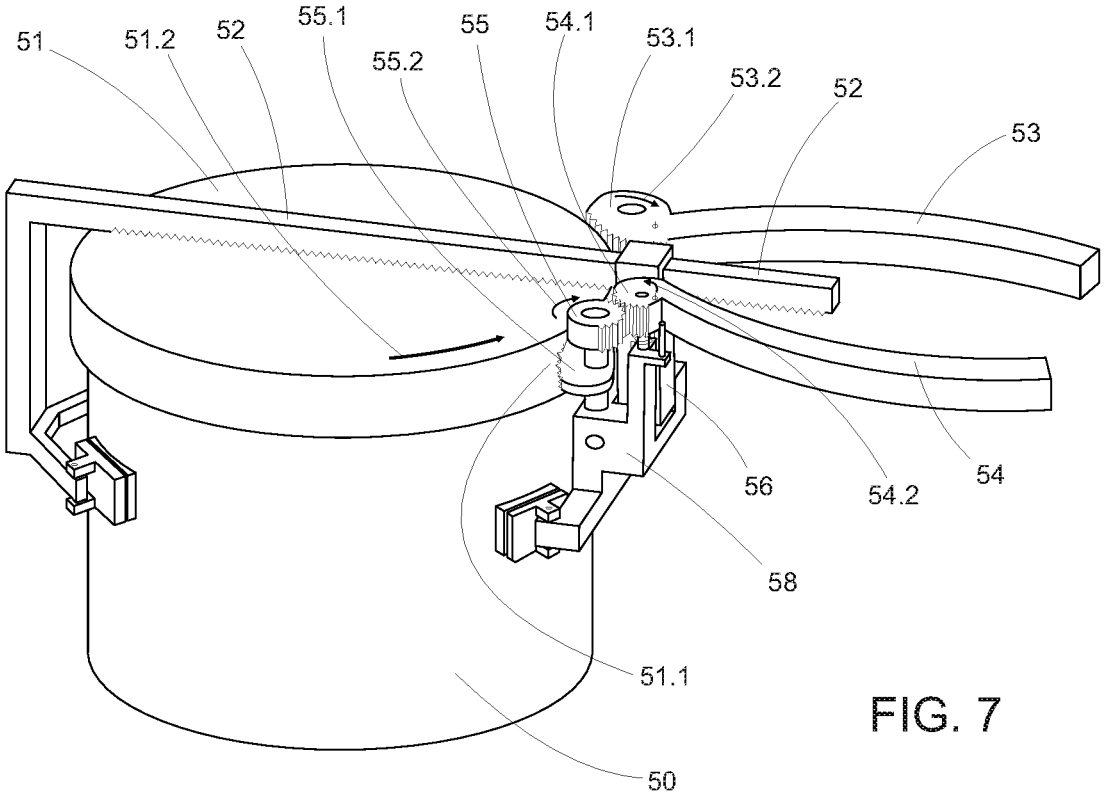
FIG. 7 illustrates an exemplary embodiment with two handles pressed together and two cams opening the lid in accordance with the jar lid opener describe herein.

Two cams 53.1 and 55.1 are rotated by two handles 53 and 54. Cam 53.1 is directly rotated clockwise 53.2 by handle 53 and it rotates lid side counterclockwise 51.2. While cam 55.1 is inversely rotated by handle 54 so it rotates lid side 51.1 counterclockwise 51.2. Handle 54 rotates counterclockwise 54.2 gear 54.1 which rotates gear 55 clockwise 55.2. Gear 55 is coupled to cam 55.1 which rotates also clockwise 55.2 and causes its pins 55.3 or rough surface 55.4 to rotate lid side 51.1 counterclockwise 51.2. As shown in FIG. 7, when handles 53 and 54 are pressed together, cams 53.1 and 55.1 rotate lid 51 counterclockwise 51.2 and open it.

The use of more than one cam, such as 53.1 and 55.1, provides better gripping and rotating of lid 51. Handles 53 and 54 are raised to the same level as arm 52 so that arm 52 does not hinder the hand pressing handles 53 and 54.

Plates 59.1 and 59.6 are rotationally coupled to jaws 59 and 59.5. Protective or gripping material 59.2 and 59.7 is coupled to plates 59.1 and 59.6. The role of plates 59.1 and 59.6 is to automatically adjust to the curvature of jar 50.

Figure 8:
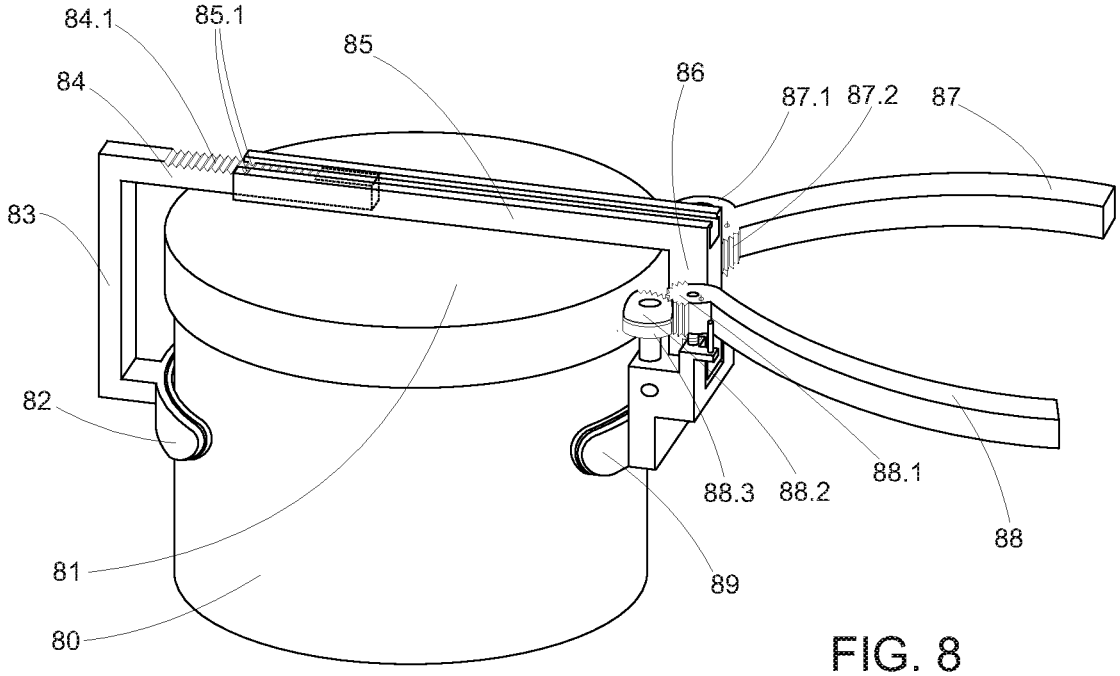
FIG. 8 is a diagram of an exemplary embodiment of two telescopic arms and two handles in accordance with the jar lid opener describe herein.

FIG. 8 is a diagram of an exemplary embodiment of two telescopic arms and two handles in accordance with the jar lid opener describe herein.

The adjustment to the size of the jar 80 is made by sliding arms 84 and 85. Arm 84 has teeth 84.1 on top and can slide inside hollow arm 85. Arm 85 has a least one tooth 85.1 which can engage teeth 84.1 when arms 84 and 85 are not aligned. Arm 84 is coupled to link 83 and arm 85 is coupled to link 86. With the technique descried earlier, cam 88.2 with its gripping material 88.3 and cam 87.1 with its teeth 87.2, cause jaws 82 and 89 to press on jar 80. This causes misalignment of arms 84 and 85 which causes teeth 85.1 to engage teeth 84.1, thus locking arms 84 and 85.

Handles 87 and 88, and cam 87.1 and gear 88.1 can be made lower since arm 85 can no longer hinder pressing of handles 87 and 88.

Figure 9:
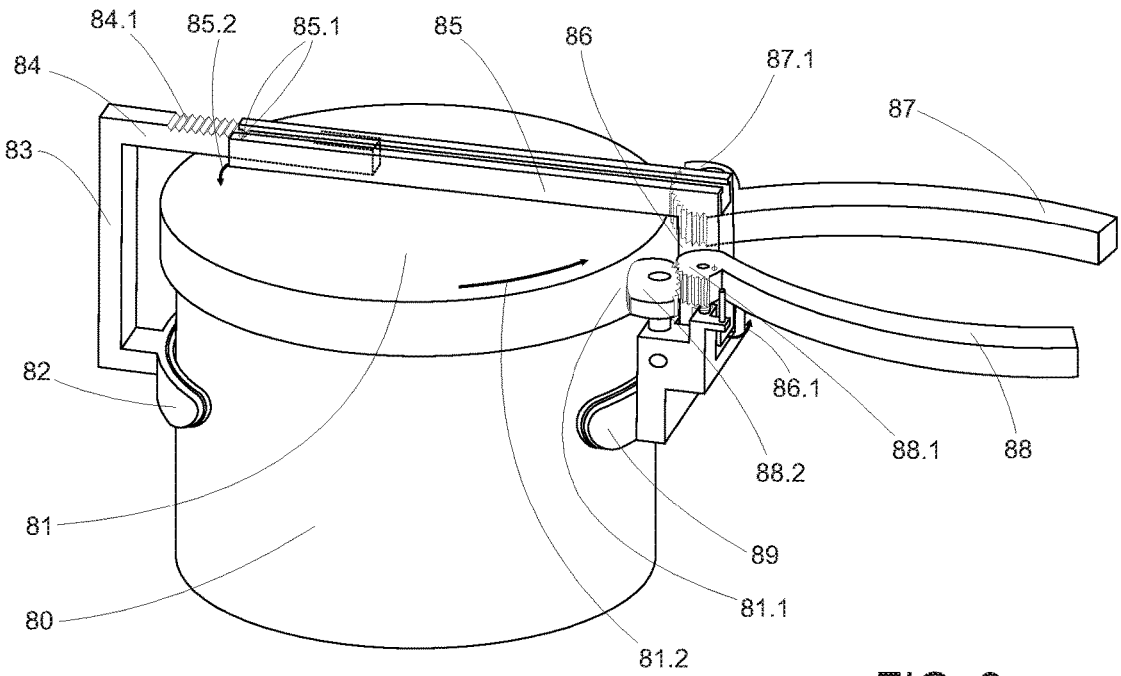
FIG. 9 illustrates an exemplary embodiment with two telescopic arms and pressed handles locking the arms and two cams opening the lid in accordance with the jar lid opener describe herein.

FIG. 9 illustrates an exemplary embodiment with two telescopic arms and pressed handles locking the arms and two cams opening the lid in accordance with the jar lid opener describe herein.

When handle 87 and 88 are pressed, link 86 rotates counterclockwise 86.1 causing arm 85 to rotate counterclockwise 85.2. This causes teeth 85.1 to engage teeth 84.1 causing arms 84 and 85 to lock. Then cams 88.2 and 87.1 cause jaws 82 and 89 to press on jar 80 and rotate counterclockwise 81.2 lid side 81.1 and open it.

Figure 10:
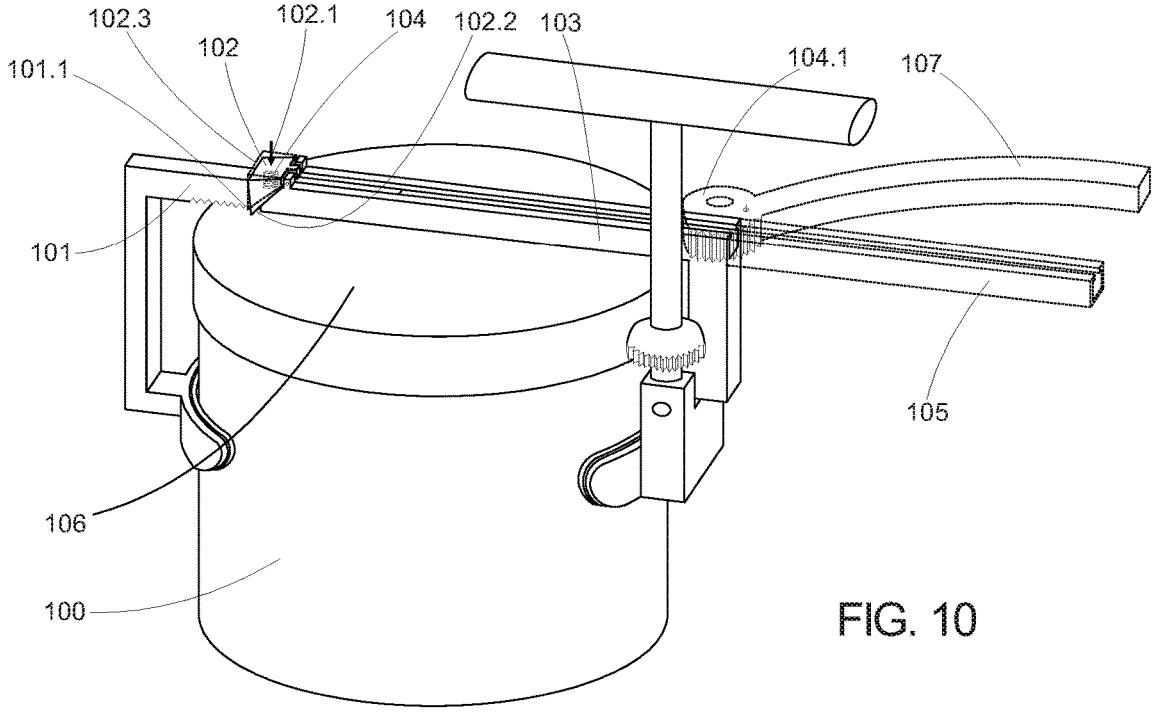
FIG. 10 illustrates an exemplary embodiment with two telescopic arms and one or two handles and a manual lock in accordance with the jar lid opener describe herein.

FIG. 10 illustrates an exemplary embodiment with two telescopic arms and one or two handles and a manual lock in accordance with the jar lid opener describe herein.

Manual lock 102 is used to lock arms 101 and 103. When manual lock is pressed by a force 102.1, tooth 102.2 is disengaged from teeth 101.1 and arm 101 can slide freely inside hollow arm 103 until the appropriate size of jar 100 is reached. Then manual lock 102 is released, spring 104 returns manual lock 102 to its home position 102.3, and tooth 102.2 is reengaged to teeth 101.1 causing arm 101 and 103 to be locked. The option of pressing handle 107 and part 105 of arm 103 will rotate cam 104.1 and open lid 106.

What is claimed is:

1. A jar lid opener comprising:

an arm with a first and second side;

a link on the first side of the arm;

a first jaw disposed at the end of the link;

a first lever slidably connected to the second side of the arm, the first lever holding the position on the arm by a locking mechanism;

a second lever rotatably connected to the first lever;

a second jaw connected to the second lever;

a handle rotatably and pivotably connected to the top of the second lever, the handle configured to rotate a cam about a first axis in respect to the second lever, the handle further configured to pivot in respect to the second lever about a second axis which is perpendicular to the first axis; wherein rotating the handle toward the arm rotates the cam which causes the first jaw and second jaw to press and hold a jar while the cam rotates the jar lid.

2. The jar lid opener of claim 1 further including at least one of a spring or a stop mechanism between the handle and second lever.

3. The jar lid opener of claim 1 further including a protective or gripping material including polymers coupled to at least one of the first jaw or second jaw.

4. The jar lid opener of claim 2 further including a protective or gripping material including polymers coupled to at least one of the first jaw or second jaw.

* * * * *